United States Patent [19]

Davis

[11] 4,190,111

[45] Feb. 26, 1980

[54] WELL CEMENTING/PLUG DRILLING APPARATUS AND IMPROVED CEMENTING AND DRILLING PROCESS

[76] Inventor: Carl A. Davis, P.O. Box 12326, Houston, Tex. 77017

[21] Appl. No.: 941,161

[22] Filed: Sep. 11, 1978

[51] Int. Cl.[2] ..... E21B 17/14; E21B 33/16

[52] U.S. Cl. ..... 166/291; 85/50 R; 166/153; 166/193; 166/242

[58] Field of Search ..... 166/99, 153, 192, 193, 166/237, 238, 285, 291, 292, 242; 85/50 R, 51, 52

[56] References Cited

U.S. PATENT DOCUMENTS

| | | | |
|---|---|---|---|
| 628,941 | 7/1899 | Janney | 85/50 R |
| 880,597 | 3/1908 | Syze | 166/242 |
| 1,362,623 | 12/1920 | Hochberger | 85/50 R |
| 1,777,614 | 10/1930 | Hauger | 85/51 |
| 2,079,140 | 5/1937 | Yarbrough | 166/237 X |
| 2,162,261 | 6/1939 | Layne | 166/291 |
| 2,165,433 | 7/1939 | Wickersham | 166/153 |
| 2,309,791 | 2/1943 | Sanders | 166/285 |
| 2,922,669 | 1/1960 | Hansen | 85/50 R |
| 3,581,817 | 6/1971 | Kammerer, Jr. | 166/285 X |
| 3,913,686 | 10/1975 | Manson, Jr. | 166/242 X |

FOREIGN PATENT DOCUMENTS

| | | | |
|---|---|---|---|
| 359715 | 9/1922 | Fed. Rep. of Germany | 85/50 R |
| 213669 | 2/1961 | Fed. Rep. of Germany | 85/50 R |
| 144206 | 10/1938 | Netherlands | 85/50 R |

*Primary Examiner*—Stephen J. Novosad
*Assistant Examiner*—George A. Suchfield

[57] ABSTRACT

A cementing/plug drilling apparatus consists of a flat plate slightly less in maximum diameter than the pipe in which it will pass having at least one protrusion or tooth on both faces, the tooth being strong enough and sharp enough to engage, dent and penetrate a cement surface and a pump down wipe plug and, the plate having an opening on each face in fluid communication with each other through a fluid passage. An improved process of cementing and drilling through a pump down wipe plug comprises placing a plate having teeth on both faces between a pump down wipe plug and the surface that the bottom of the plug contacts during the cementing process, so that when the drill bit contacts the plug the teeth on the top of the plate engage and hold the plug and the teeth on the bottom of the plate engage and hold the surface on which they are in contact, thereby retarding the tendency of the plug to slide over the surface below it and enhancing the drilling action of the drill bit.

15 Claims, 10 Drawing Figures

FIG. 1
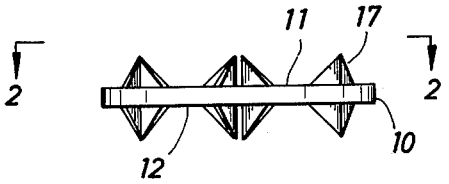
FIG. 5
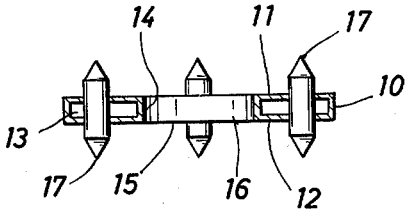
FIG. 2
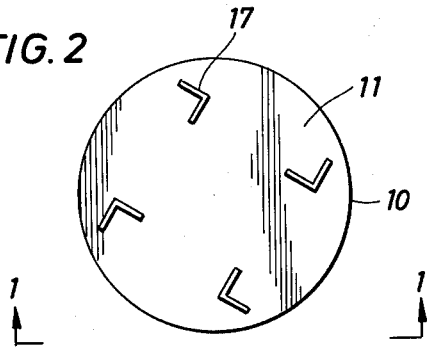
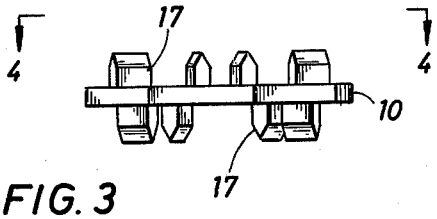
FIG. 3
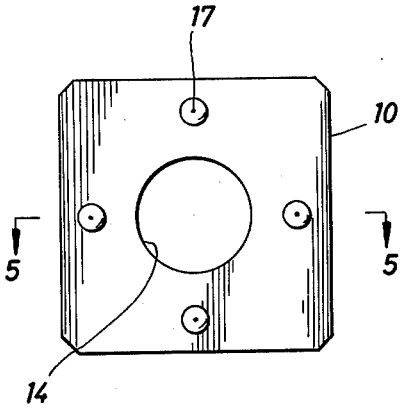
FIG. 6
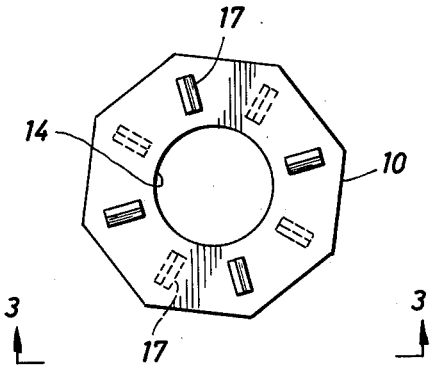
FIG. 4

FIG.7
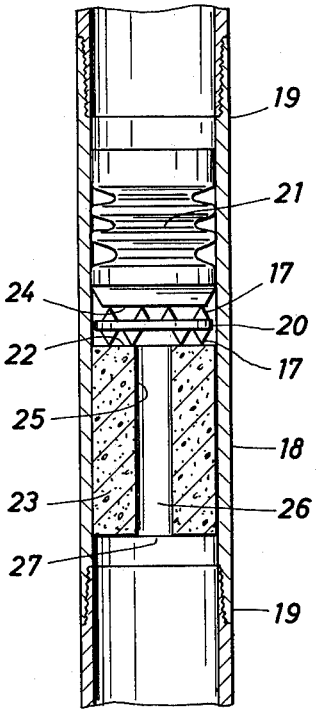
FIG. 8
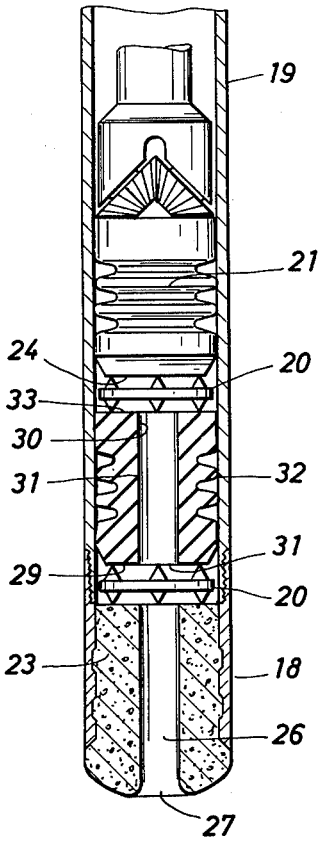
FIG. 9
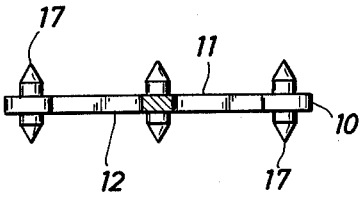
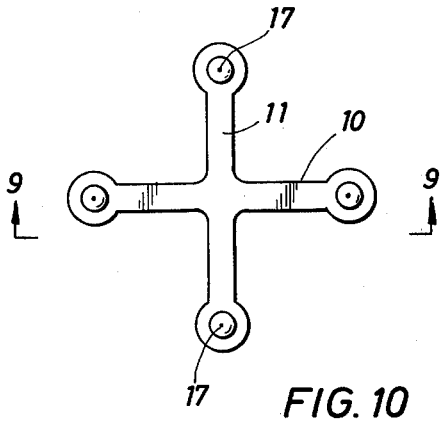
FIG. 10

WELL CEMENTING/PLUG DRILLING APPARATUS AND IMPROVED CEMENTING AND DRILLING PROCESS

BACKGROUND OF THE INVENTION

The cementing process is one of the most important processes in drilling and completing a well. It is an intimate part of the running of casing. Cementing is done at various points in the well and at various times while drilling both inside and outside of the casing.

The primary cementing can form a protective sheath around the casing, segregating producing formations to prevent migration of undesirable fluids. Secondary cementing takes place after the primary cementing and can be used to squeeze cement into the perforations in the casing or to seal off, isolate or repair parts of the well. Plug back cementing is used to place cement at desired points in the well or to shut off the bottom water or reduce the depth of the well.

Two of the apparatuses or pipe attachments routinely used in the cementing operations are the collar and the shoe. These are typically cement restrictions or shoulders which are attached to a pipe string as a part of the pipe string. The collar, for example a float collar, is inserted between the top and bottom of a casing string usually one or two joints above a float shoe which is attached to the bottom of a pipe string. Shoes and collars, among a number of things, help prevent the back flow of cement during the cementing operation. The collars and the shoes are usually equipped with a check valve (often a ball valve means) to aid in the prevention of back flow of cement. The shoes and collars are typically an outer cylindrical housing or pipe and an inner cement tube communicating with and fixed to the inner surface of the cylindrical housing, with a fluid passage running the length of the cement tube. When there is a check valve, it is usually part of an inner housing in concentric spaced relationship with the outer housing so that the cement tube fills the space between the two housings and the inner housing forms part of the fluid passage.

In addition to the collars and shoes typical cementing operations employ one or more pump down plugs. Pump down wipe plugs can serve three purposes: (1) to separate or serve as the interface between the wet cement from the fluid it is displacing or the fluid which is being used to pump the wet cement to the desired level; (2) to wipe off the inner surface of the pipe string as it passes; and (3) to help prevent back flow while the cement is setting up.

In practice the well operator makes up his pipe string so that the collar or shoe is lowered into the well to the desired level. When he decides to cement he may place a bottom pump down wipe plug between the fluid already in the well and the wet cement. This bottom plug has a fluid passage through it which is sealed by a diaphragm or membrane. The cement is pumped into the well forcing the bottom plug down the well, displacing the fluid in front of it, until it reaches the top of the cement tube of the shoe or collar or shoulder. This restriction stops the plug and increased pumping pressure breaks the diaphragm or membrane and the cement passes through the plug and through the fluid passage of the collar or shoe. After the desired amount of cement is pumped into the well a top pump down wipe plug is inserted to act as the interface between the fluid used to force the cement to the desired level for the cement.

Often the bottom plug is not used and only one plug as the interface between the cement and the fluid used to force the cement to the desired level is used. The top plug is usually pumped until it comes in contact with the bottom plug if one is used or the top of the cement tube part of the shoe or collar. The cement is allowed to set or harden and the well operator then carries out whatever other operations he intends to do.

The plugs used in the above operation are usually made of a pliable or rubbery material, such as plastic, wood or rubber, sometimes with hollow metal or plastic cores and they fit snugly in the pipe string. All of the plug is made of drillable material.

Once the cement has set up and the well operator has carried out his desired operations he may decide to drill out the plug and/or plugs, collar or shoe and the cement. The plugs are typically made of drillable material, as are the cement tube and and innerhousing of the collar and shoe and of course, the cement which was pumped into the well. The well operator lowers the drill string into the well until the drill bit contacts the plug and he begins to drill by rotating the drill bit, usually clcokwise. In many instances the rotation of the drill bit will cause the plug with which it is in contact to rotate, slipping over the surface on which it rests, i.e., cement, a bottom plug or the cement tube of the shoe or collar. This tendency of the plug to rotate as the bit rotates, to slide across the surface below it, wastes both time and energy. Since all of the components are made of readily drillable material, this wasting of time and energy in the drilling process is an unnecessary problem.

The present invention is an apparatus to be placed between a pump down wipe plug and a cement surface or between two plugs within a well in order to enhance the drillability of the plugs and an improved process for cementing with and drilling through a pump down wipe plug.

SUMMARY OF THE INVENTION

The invention relates to a drillable plate having at least one drillable protrusion or tooth-like means protruding or extending from each face of the plate where the end of the protrusion furtherest from the plate is sharp, the protrusions being strong enough and sharp enough to engage a pump down wipe plug and a cement surface, thereby retarding the tendency of the plug to rotate when contacted by the rotating drilling bit. The invention further relates to a drillable plate having at least one drillable protrusion on each face and a fluid passage through the plate in fluid communication with an opening on each face, the positioning of the openings being such that they would communicate with the fluid passage and top and bottom openings on a collar or shoe with which the plate came in contact. The improved process of cementing within a well using a pump down wipe plug and a collar or shoe and subsequently drilling through the plugs where subsequent to positioning a collar or shoe in a well, one inserts a plate having at least one protrusion on each face into the pipe, followed by a pump down wipe plug at the interface of the wet cement and the fluid used to force the plug and the cement down the well, forces the plug and the plate down the well until the protrusions on the bottom face are in contact with and engaged in the top surface of a shoe or collar and the protrusion on the top face of the plate is in contact with and engaged in the bottom of the pump down wipe plug. Subsequently, after the cement has set, a drill bit is lowered on a drill string where it presses on the top of the plug forcing the protrusion further into the cement and the plug so that the tendency of the plug to rotate with the rotaing drill bit is retarded or stopped and the drilling action of the bit on the plug is enhanced. The improved process of cementing using a collar or shoe, a bottom pump down wipe plug and a top pump down wipe plug and subsequently drilling through the top plug and the bottom plug comprises, introducing a plate having at least one protrusion on both its top and its bottom face, said plate having an opening on its top and on its bottom with a passage in fluid communication with the top and bottom openings, next introducing a bottom pump down wipe plug, said plate top opening being in fluid communication with the bottom opening of the fluid passage of the bottom plug and said bottom opening being in fluid communication with the top opening of the fluid passage of the shoe or collar, next introducing the desired amount of cement, followed by a second plate having at least one protrusion on the top face and at least one protrusion on the bottom face, following by a top pump down wipe plug at the interface of the wet cement and the fluid used to pump the wet cement and the top plug, forcing the first plate into the top of the shoe or collar, the bottom plug onto the top protrusion of the first plate, the bottom protrusion of the second plate onto the top of the bottom plug and the top plug onto the top protrusions of the second plat, allowing the cement to set or harden, then subsequently lowering a drill bit onto the plugs, the protrusions on the second plate serving to retard the tendency of the top plug to rotate over the top surface of the bottom plug and the protrusion of the first plate serving to retard the rotation of the bottom plug over the surface of the shoulder of the shoe or collar, thereby enhancing the drilling of the top and bottom plugs.

BRIEF DESCRIPTION OF THE DRAWING

FIG. 1 is a side view of the circular plate of FIG. 2 showing four angle iron shaped protrusions or teeth on each face.

FIG. 2 is a view of one face of the plate of FIG. 1.

FIG. 3 is a side view of the polygon shaped plate of FIG. 4 with four bar like protrusions or barbs on each face and a fluid passage through the plate.

FIG. 4 is a view of the face of the plate of FIG. 3.

FIG. 5 is a sectional view of the square plate of FIG. 6 along line 1—1' where the plate has a hollow core, having four rod-like protrusions on each face and having a fluid passage through its center.

FIG. 6 is a view of the face of the plate of FIG. 5.

FIG. 7 shows the plate and its position between a collar and single plug following a cementing operation.

FIG. 8 shows the use of two plates when employing both a top and a bottom plug at the beginning of the plug drilling operation.

FIG. 9 is a sectional view of the apparatus of FIG. 10 taken through line 2—2'.

FIG. 10 is an example of the apparatus viewed from either face showing an irregular circumference.

DESCRIPTION OF THE PREFERRED EMBODIMENT

The well cementing and plug drilling apparatus will be described further by reference to the FIGS.

FIGS. 1–6, 9 and 10 show illustrative examples of a well cementing/plug drilling apparatus in which there is a drillable plate 10 having a top or first face 11 and a bottom or second face 12. The shape of the plate 10 when viewed perpendicular to either face 11 or 12 can be any shape, circular, square or a polygon, but the maximum distance between any two points on the outer circumference of the plate 10 is less than the inside diameter of any well pipe through which the plate 10 must pass. To insure that the plate will not pass through any openings in the bottom plug or in the well collar or shoe, it is preferred that the circumference of the plate in every direction be larger than the openings in any bottom plug or well collar or shoe with which the plate may come in contact. The preferred shape of the face of the plate is a circle between about 1.27 and about 3.71 centimeters less in diameter than the inside diameter of the well in which it will travel. The distance between the faces 11 and 12 can be any distance, i.e., the thickness of the plate can be any thickness, but it is preferred that it be between about 0.6 and about 3 centimeters in thickness, preferably between about 0.7 and about 2 centimeters in thickness. It is possible to have the thickness vary across the face but the preferred embodiment of the invention is to have the faces of the plate 11 and 12 parallel to each other, i.e., a uniform distance apart; a flat plate.

The plate is made of drillable material. The preferred materials are rigid metals, plastics and woods which are strong enough to withstand the torque exerted on them by the tendency of the plugs with which they are in contact to rotate. The most preferred materials are metals and the preferred metals are cast iron and aluminum, while aluminum is the most preferred metal.

The plates can be solid or they can be made with hollow cores 13, as in FIG. 5. The use of hollow cores 13 allows greater latitude in adjusting the density of the apparatus 10 so that the apparatus 10 can be made less dense than the fluid in which it is submerged, i.e., mud or cement, even when the density of the material the plate is made of is greater than the fluid in which it is floating.

For a preferred embodiment of the invention, there is a fluid opening 14 on the face 11 and a fluid opening 15 on face 12 with a fluid passage 16 in fluid communication with the openings 14 and 15.

Protruding from both face 11 and from face 12 are at least one protrusion or tooth-like means 17. These protrusions or teeth 17 are rubber denting, penetrating and rending teeth. These protrusions or barbs 17 may be rods or bars or angle irons made of drillable material capable of withstanding the torque applied to the protrusions 17 by the tendency of the plugs to rotate caused by the rotating drill bit. The preferred materials are metal, plastic and wood. The most preferred materials are metals; aluminum and cast iron are the preferred metals, and aluminum is the most preferred metal.

The number of protrusions or teeth 17 per face 11 or 12 is between 1 and about 10 inclusive, preferably between 2 and 8 inclusive and most preferably between 4 and 6 inclusive. The minimum length of a protrusion 17 is about 1.27 centimeters. The preferred length of the protrusion is between about 1.27 and about 7 centimeters, most preferably between about 2.54 and about 5 centimeters.

The ends of the protrusion or teeth furtherest from the surface from which they protrude are sharp, either pointed, FIGS. 1, 2, 5, 9 and 10, or blade-like, FIGS. 3 and 4, preferably pointed. The protrusions must be sharp enough to dent and penetrate the plugs and the cement when pressure is applied to the top of a plug by the drill bit.

The well cementing and plug drilling apparatus can be made by casting or manufacturing the protrusions 17 as part of the plate 10, fixing, i.e., welding, the protrusions 17 to the face of the plate or where a bar, rod or angle iron shaped member is used simultaneously as the protrusion 17 on both faces 11 and 12, the bar, rod or angle iron shaped member may pass through the plate and be welded to the plate.

The improved process of cementing and plug drilling will be described with reference to FIGS. 7 and 8. The improved cementing and plug drilling process comprises introducing the cementing and plug drilling apparatus between the shoe or collar and a plug and between top and bottom plugs during the cementing operation; then after the cement has set, drilling away the plug or plugs with the aid of the cementing and plug drilling apparatus which retards or stops the tendency of the plug or plugs to rotating with the rotating motion of the drill bit.

In one embodiment of the invention, FIG. 7, the shoe or collar 18 is lowered to the desired level and wet cement introduced into the well. When the desired amount of cement has been pumped down the pipe 19, a cementing and plug drilling apparatus 20 is introduced, followed by a pump down wipe plug 21. The plug is forced down the well by a fluid such as mud or water until the protrusions or teeth 17 of one of the faces 11 or 12 of the cementing and plug drilling apparatus 20 have come to rest on the top surface 22 of the cement tube 23 of the shoe or collar 18 and the bottom surface 24 of the plug 21 comes to rest on the protrusions or teeth 17 on the opposite face of the same apparatus 20.

If the apparatus 20 does not have a fluid passage 16 where the opening 14 and 15 correspond in position so that the cement may freely pass through the cement tube top opening 25, passage 26, and bottom opening 27, or an irregular or star shape such that cement may pass by the apparatus 20, then the apparatus 20 may interfer with the passage of cement. To overcome this, the apparatus 20 may be chosen so that the density is less than cement and preferably introduced immediately before the plug. Alternatively, the apparatus can be attached to the bottom 24 of the plug 21 by embedding the teeth 17 of the apparatus 20 into the bottom 24 of the plug 21. Then the plug 21 and the apparatus 20 descent the pipe as the interface between the cement and the forcing fluid at the same time.

Once the plug comes to rest one has a well configuration comprising a shoe or collar, upon which rests an apparatus 20, its teeth 17 of face one 12, communicating with the surface 25 of the cement tube 23, upon the apparatus 20 rests a pump down wipe plug 21, its bottom surface 24 resting on the teeth 17 of the second surface 11 of the same apparatus.

In another embodiment of the invention the pipe configuration comprises a shoe or collar 18 upon which rests the teeth 17 of a first apparatus 20, upon the teeth of the opposite face of the apparatus 20 rests the bottom 28 of a bottom plug 29, said bottom plug having a top opening 30, a bottom opening 31 and a fluid passage 32 in fluid communication with the openings 30 and 31, on top 33 of the bottom plug 29 is a second apparatus 20, its teeth resting on the top 33 of the bottom plug on top of the second apparatus 33, is a top pump down wipe plug 21 its bottom 24 resting on the teeth 17 on the opposite face of the second apparatus 20. The process to obtain the above well pipe configuration comprises lowering the shoe or collar 18 to the desired level, introducing a first apparatus 20 followed by a bottom pump down wipe plug 32, this plug having a membrane strong enough to maintain the interface between the cement and a second fluid unitl the plug is held in place by a restriction. Adding the desired amount of cement and a second apparatus 20 followed by a to pump down wipe plug 21, the bottom teeth 17 of the second apparatus 20 resting on the top surface 33 of the bottom plug 32 and the bottom surface 33 of the top plug 21 resting on the top teeth 17 of the second apparatus 20. In the preferred embodiment of the invention, the teeth 17 on the face 11 are essentially identical to the teeth 17 on face 12 so that the top teeth 17 and face 11 are merely those teeth 17 and face 11 that face upward relative to the earth.

In the case where there is both a top plug 21 and a bottom plug 32, it is necessary to ensure that fluid can easily flow past the first apparatus 20, between the bottom plug 32 and the collar or shoe 18. This may be done by choosing an apparatus 20 with a fluid passage (as in FIGS. 3–6) or by choosing an irregular shape plug (like FIGS. 9 and 10).

To help ensure that the apparatus 20 reaches the surface on which it will rest so that the faces 11 and 12 are essentially perpendicular to the pipe 19, the apparatus 20 may be chosen so that the material from which it is made or a hollow core 13 ensure that its density is less than the fluid in which it will float and add the apparatus 20 immediately before the plug, bottom 32 or top 21, which serves to separate the different fluids. It is also possible to stick or attach the apparatus 20 on to the bottoms of each plug by having the teeth 17 penetrate the plug or even attaching one apparatus to the bottom 29 of the bottom plug 32 and another to the top 33 of the bottom plug 32. In this way the plugs and the apparatus travel together down the pipe.

If the fluid passage 31 of the bottom plug 32 has an irregular cross section so that the cement which hardends in the fluid passage 31 forms an irregularly shaped vertical bar that retards the tendency of the bottom plug 32 to be rotated by the action of the bit then it is possible to eliminate the use of the apparatus 20 between the bottom plug 32 and the collar or shoe 18.

Once the cement has hardened and the operator desires to drill through the plug or plugs, a drill bit is lowered on to the uppermost plug forcing the plugs further down on to the teeth 17 on the face 11 of the apparatus 20, on which they rest and the bottom teeth 17 of the face 12 of the apparatus 20 further down into the surface (bottom plug 32 or cement) in which they rest. The rotating drill bit drills through the plug or plugs which are held stationary or their tendency to rotate is retarded by the apparatus 20, thereby making the drilling action of the bit more effective.

I claim as my invention:

1. An oil well cementing/pump down wipe plug drilling apparatus for use in a process of cementing and drilling within an oil well which comprises pumping a pump down wipe plug made of drillable plastic, wood, rubber or metal, as the interface between wet cement and a second liquid, down a pipe string until it contacts the top surface of a second pump down pipe plug or the cement shoulder of a collar or shoe, allowing the cement to dry, and subsequently drilling through the plug with a rotating drilling bit, comprising:

(a) a rigid drillable plate having a bottom face and top face, said plate having a maximum diameter across the face slightly less than the inside diameter of the smallest pipe in the string into which it will go and a minimum diameter greater than any fluid passage in the plug; second plug or collar or shoe with which the apparatus will come in contact;

(b) at least one drillable sharp protrusion protruding from each face of the plate, said protrusion being made of a material selected from the group consisting of metal, plastic and wood, said apparatus to be inserted between the plug and the surface upon which the plug rests, so that the protrusion engages the bottom of the plug and the surface thereby retarding the tendency of the plug to rotate when contacted by a rotating drilling bit.

2. The well cementing/plug drilling apparatus of claim 1 where the height of the protrusion is between about 1.27 and about 7 centimeters.

3. The well cementing/plug drilling apparatus of claim 2 where the number of protrusions per plate face is between 2 and 8 inclusive.

4. The well cementing/plug drilling apparatus of claim 3 where the plate and protrusions are made of a material selected from the group consisting of cast iron and aluminum.

5. The well cementing/plug drilling apparatus of claim 4 having an opening on the top face in fluid communication through a fluid passage with an opening on the bottom face.

6. The well cementing/plug drilling apparatus of claim 4 where the shape of the plate when viewed perpendicular to a face is star shaped.

7. An oil well cementing pump down wipe plug drilling apparatus to be placed in a pipe string between the bottom surface of a first plug and the top surface of a second pump down wipe plug or the cement shoulder of a collar or shoe comprises a drillable rigid metal plate having a top face and a bottom face, with a maximum diameter across the face of between about 1.27 and about 3.71 centimeters less than the inside diameter of the well into which it will go and a minimum diameter greater than the fluid passages in the plugs or collar or shoe with which the apparatus will come in contact, and having between 4 and 6, inclusive, drillable metal sharp protrusions protruding between about 2.54 and about 5 centimeters above the top face and between 4 and 6, inclusive, drillable metal sharp protrusions protruding between about 2.54 and about 5 centimeters below the bottom face.

8. A well pipe configuration comprising, moving up the pipe string:

(a) a well shoe or collar pipe attachment having a cement tube adapted to receive a pump down wipe plug;

(b) a cementing/plug drilling apparatus comprising a drillable rigid plate having a top face and a bottom face and having at least one drillable top protrusion upward from the top face and at least one drillable bottom protrusion protruding downward from the bottom face, said bottom protrusion in contact with the top of the cement tube, and (c) a pump down wipe plug, the bottom of the plug in contact with the top protrusions of the apparatus of b).

9. The configuration of claim 8 where the apparatus of (b) has an opening on the top face in fluid communication through a fluid passage with an opening on the bottom face, where the pump down wipe plug of c) is a bottom pump down wipe plug and where on top of the bottom pump down wipe plug is, (d) a second cementing/plug drilling apparatus comprising a drillable rigid plate having a top face and a bottom face and having at least one drillable top protrusion proturding upward from the top face and at least one drillable bottom protrusion protruding downward from the bottom face, the bottom protrusions of the second apparatus in contact with the top of the bottom pump down wipe plug of (c), and (e) a top pump down wipe plug, the bottom of the top pump down wipe plug being in contact with the top protrusions of the second apparatus of (d).

10. The configuration of claim 9 where the second apparatus of d) has an opening on the top face in fluid communication through a fluid passage with an opening on the bottom face.

11. In the process of cementing within a well and drilling through a pump down wipe plug comprising pumping a desired amount of wet cement into the cementing string, followed by a pump down wipe plug at the interface of the wet cement and the fluid used to force the cement to the desired level, forcing the cement and plug down the string until the plug contacts the cement tube of a well shoe or collar pipe attachment, allowing the cement to harden, then drilling out the plug with a rotating drill bit, the improvement which comprises introducing a cementing/plug drilling apparatus between the cement tube and the pump down wipe plug said apparatus comprising a drillable rigid plate having a bottom face and a top face and at least one drillable protrusion protruding from each face, contacting the top of the plug with a rotating drilling bit, forcing the protrusion on the top face to engage the bottom of the plug and the protrusion on the bottom face to engage the top of the cement tube thereby retarding the tendency of the plug to rotate with the rotating bit and enhancing the drilling action of the bit.

12. In the process of cementing within a well and drilling out a pump down wipe plug, which comprises introducing into the well pipe string a bottom pump down wipe plug, followed by the desired amount of wet cement, followed by a top pump down wipe plug, forcing the wet cement and plugs down the string until the bottom of the bottom plug contacts the top of the cement tube of a well shoe or collar pipe attachment and bottom of the top plug contacts the top of the bottom plug, allowing the cement to harden, then drilling out the plugs with a rotating drilling bit, the improvement which comprises introducing a first cementing/plug drilling apparatus between the top of the cement tube and the bottom of the bottom plug, and introducing a second cementing/plug drilling apparatus between the top of the bottom plug and the bottom of the top plug, said first and second apparatus comprising a drillable rigid plate having a top face and a bottom face with at least one drillable sharp protrusion from each face, the first apparatus having an opening on the top face in fluid communication through a fluid passage with an opening on the bottom face, drilling out the top plug, the second apparatus and the bottom plug, the top plug's tendency to rotate being retarded by the protrusion of the second apparatus which engages the bottom of the top plug and the top of the bottom plug and the bottom plug's tendency to rotate being retarded by the protrusions of the first apparatus which engages the bottom of the bottom plug and the top of the cement tube thereby enhancing the drilling action of the rotating bit on the two plugs.

13. The improved process of claims 11 or 12 where the apparatus is introduced by attaching the apparatus to the plug by forcing the protrusions to engage the plug and simultaneously introducing the plug and the apparatus down the cementing pipe string.

14. A well pipe configuration comprising, moving up the pipe string:

(a) a first pump down wipe plug;

(b) a cementing/plug drilling apparatus comprising a drillable rigid plate having a top face and a bottom face and having at least one drillable top protrusion protruding upward from the top face and at least one drillable bottom protrusion protruding downward from the bottom face, said bottom protrusion in contact with the top of the first pump down wipe plug;

(c) a second pump down wipe plug, the bottom of the plug in contact with the top protrusions of the apparatus of b).

15. The configurations of claims 8, 9, 10 or 14 where the number of protrusions on each face of the apparatus is between 2 and 8, inclusive.

* * * * *